United States Patent [19]

Kreth et al.

[11] Patent Number: 4,624,166

[45] Date of Patent: Nov. 25, 1986

[54] KITCHEN SLICER HAVING AN ADJUSTABLE KNIFE

[75] Inventors: Julius Kreth, Pfungstadt; Alfons Schreiber, Ebenweiler; Willi Steinko, Nassau, all of Fed. Rep. of Germany

[73] Assignee: Mike & Kremmel Limited, Kowloon, Hong Kong

[21] Appl. No.: 788,918

[22] Filed: Oct. 18, 1985

[51] Int. Cl.[4] ..... B26D 1/02

[52] U.S. Cl. ..... 83/699; 83/856; 30/283

[58] Field of Search ..... 83/856, 857, 858, 699; 30/124, 278, 283

[56] References Cited

U.S. PATENT DOCUMENTS 773,769 11/1904 Thompson ..... 83/699

2,766,793 10/1956 Duszynski ..... 83/856 X

*Primary Examiner*—James M. Meister

*Attorney, Agent, or Firm*—Townsend and Townsend

[57] ABSTRACT

A kitchen or domestic food slicer having a flat bed surface over which the food is moved and a knife mounted essentially across that surface. The knife alone being pivotably mounted such that its sharp leading edge can be raised or lowered relative the bed surface to vary the thickness of cut. The pivoting of the knife is achieved by cam surfaces on a pair of bars one positioned either side of the bed surface, the bars being slidable lengthwise by a rotatable knob and the cam surfaces including inclined portions to cause pivoting of the knife as the bars slide longitudinally.

3 Claims, 6 Drawing Figures

KITCHEN SLICER HAVING AN ADJUSTABLE KNIFE

BACKGROUND AND SUMMARY OF THE INVENTION

This invention relates to a kitchen or domestic food slicer.

Various simple forms of kitchen slicers for domestic use are known but have not proved particularly satisfactory for enabling a range of slice thickness to be achieved. In one form, a flat bed is provided and the food item to be sliced is reciprocated back and forth over the bed. The bed is in two parts and one is tipped with a knife blade. This part can be raised or lowered relative the other part so as to provide an opening bounded by the knife blade. Then as the food item is drawn past this opening the knife blade takes a slice from the food item. The manner of adjustment and the extent to which the one part is raised above the other so as to vary the slice in thickness is not simple, convenient and consistent.

Other known kitchen slicer designs are disclosed in British Patent Nos. 395105; 848046; and 881919. These designs provide for adjustment of the slice thickness by various mechanisms, but each has the drawback of being relatively complex in either or both of structure and operation. It is the primary aim of the present invention to provide an improved kitchen or domestic food slicer which is simple both to adjust and operate.

According to the invention, a kitchen or domestic food slicer comprises a substantially flat bed surface over which a food item to be sliced is manually reciprocable; a knife traversing the bed surface in an opening therein and pivotable about an axis substantially transverse to said direction of reciprocation, the knife having a sharp leading edge; a sliding bar positioned at either side of the bed surface, the bars having inclined cam surfaces engaging opposite ends of the knife, and being mounted longitudinally to vary the angle of the knife in the opening and thereby to raise or lower the sharp leading edge of the knife relative to the surface so as to alter the thickness of a slice severed from the food item; and means for positioning the bars to set the knife to cut a preselected slice thickness.

In the kitchen slicer of the invention, therefore, it is only the knife blade itself which is moved to adjust the thickness of the slice and the slicer can readily be adjusted to preset the required slicing thickness.

Preferably, movement of the sliding bars is accomplished via a rotatable knob at one end of the bed surface which is linked to the bars such that rotation of the knob is translated into lengthwise movement of the bars, thereby to adjust the angle of the knife in the opening. In such an embodiment, the user can quickly and simply preset and select the angle of the knife, and so the slice thickness, by rotation of the knob to a desired position, e.g. relative a scale marking, and the resulting knife position will be retained during the cutting operation and the knife held securely in that orientation by engagement of its opposite side edges with the cams on the sliding bars.

A kitchen slicer according to the invention will now be described with reference to the accompanying drawings.

DESCRIPTION OF THE PREFERRED EMBODIMENT

Figure 1:
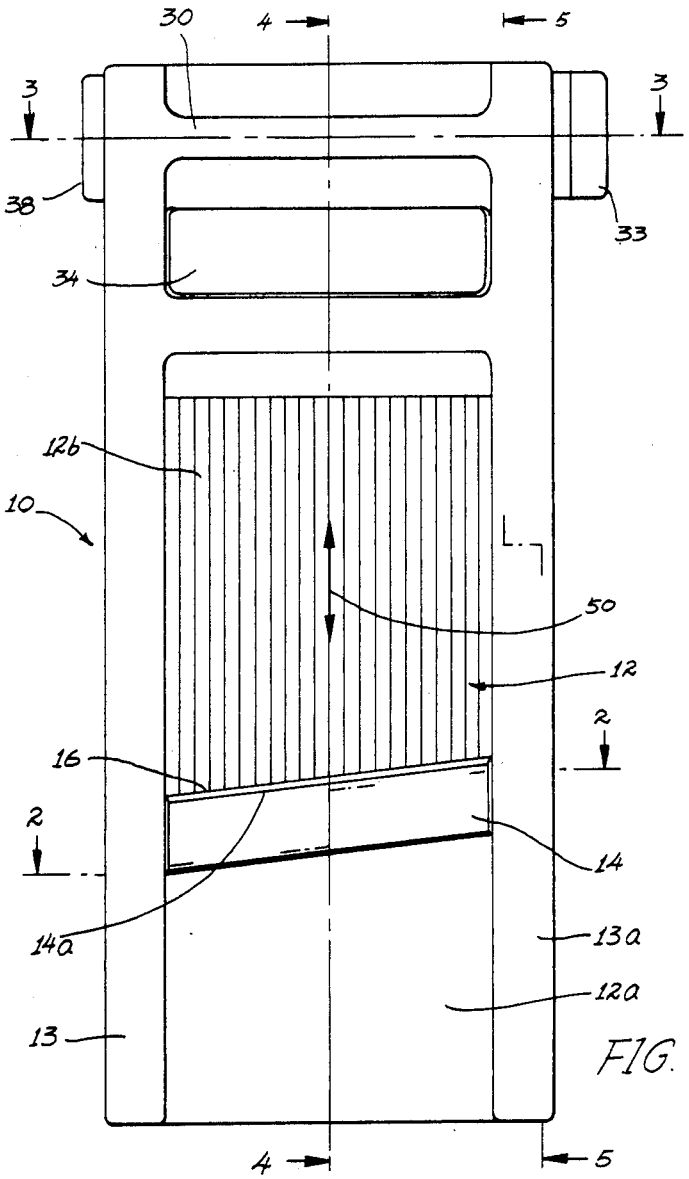
FIG. 1 is a plan view of the kitchen slicer in two halves, the left-hand half having the knife at a shallow angle to give thinner slices whilst the right-hand half has the knife inclined at a steeper angle to give thicker slices.
Figure 2:
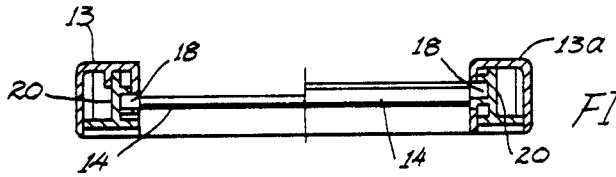
FIG. 2 is a section taken along lines 2—2 of FIG. 1.
Figure 4:
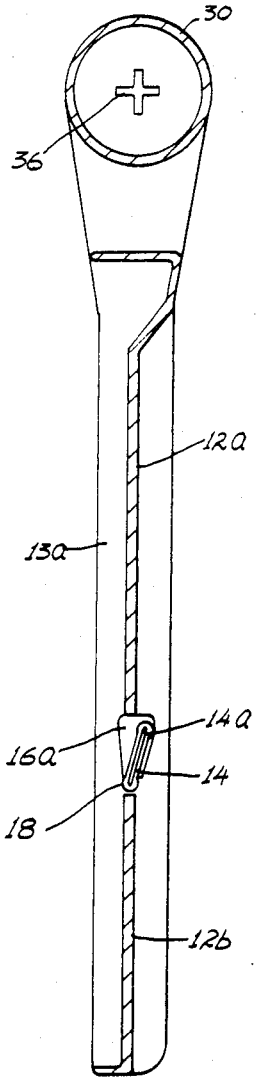
FIG. 4 is a section taken along lines 4—4 of FIG. 1.

The kitchen slicer 10 shown in the drawings includes a substantially flat bed surface 12 and on either longitudinal side of this is an integrally formed hollow strengthening flange 13 or 13*a*. Partway along the surface 12 is an opening which is positioned a knife blade 14 which extends essentially transversely across the surface 12. It is however inclined at a slight angle to the transverse. The surface 12 is separated into two parts by the knife blade 14 and opening 16. One part 12*a* is completely flat and smooth whilst the other part 12*b* is slightly fluted to assist in sliding a food item to be sliced over it.

The knife blade 14 has a sharp leading edge 14*a*. At each side edge the metal knife blade is embedded in dumb-bell shaped plastics members 18. These members 18 extend through openings 16*a* into the hollow strengthening flanges 13 and 13*a*.

Slidably positioned within each hollow strengthening flange 13 or 13*a* is a bar 20. Each bar has integrally formed therewith cam flanges 22. These have an end portion 24 which extends approximately longitudinally of the bar 20 and an inclined portion 26. The enlarged ends of the dumb-bell shaped members 18 slidably fit within the respective cam flange 22.

Figure 6:
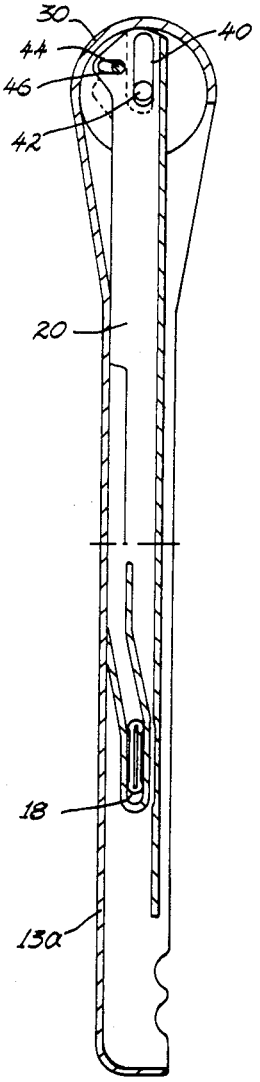
FIG. 6 is a section similar to FIG. 5 except that it is taken after adjustment of the inclination of the knife blade to a shallow angle.
Figure 5:
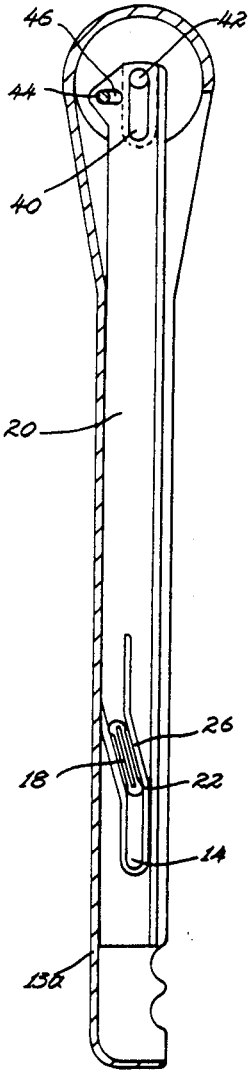
FIG. 5 is section taken along lines 5—5 of FIG. 1.
Figure 3:
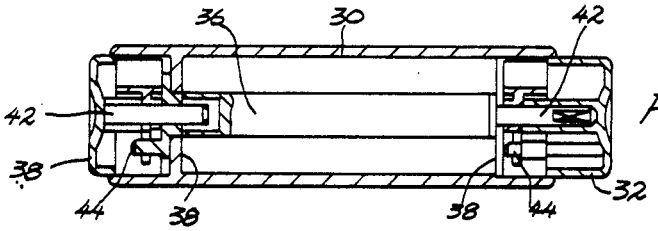
FIG. 3 is a section taken along lines 3—3 of FIG. 1.

As best shown in FIG. 6, when the sliding bar 20 is moved upwardly in the sense of FIG. 6 towards one limit of its movement, the dumb-bell shaped members 18 are positioned in the portion 24. As the bar 20 is moved away from that limit position (downwardly in the sense of FIGS. 5 and 6), one end of the dumb-bell member enters the portion 26 and progressively causes the member 18 to become more and more inclined relative the longitudinal direction of movement of the bar 20. Finally, the other limit position is reached which is shown in FIG. 5 where the whole of the dumb-bell member 18 is positioned in the portion 26 and as a result the dumb-bell shaped members and the knife which they support are inclined at a maximum to the surface 12.

Integrally formed with the surface 12 and flanges 13 and 13*a* is a top housing 30. This is substantially cylindrical and rotatably journalled by it is an operating knob 32. The top portion 30 also includes an opening 34 for assisting a user to grasp the portion 30 during use.

The knob 32 is mounted on a central rod 36 of cross-shaped section to the other end of which is joined a shallow rotatable knob 38. This knob 38 extends outwardly from the top portion 30 to a much smaller extent that the knob 32. The rod 36 is journalled for rotation in openings in transverse flanges 38 formed with the top portion 30.

Each bar 20 has near its end a slot 40 through which spigots 42 at the ends of the rod 36 extend whilst each of the knobs 36 and 38 carry small lugs 44 which engage in a further slot 46 extending transversely of the slot 42. The slots 40 allow the bars 20 to slide longitudinally between the limit positions shown in FIGS. 5 and 6 whilst rotation of the knobs 32 and 38 moves the bars 20 between these limit positions by virtue of the engagement of the lugs 44 in the slots 46. Rotation of the knob 32 moves the bars 30 which in turn adjusts the angle of the knife 14.

The frictional engagement between the member 18 and the flanges 22 and the friction of the other parts is such that the knife will retain its preset angle despite the large cutting forces applied to it during slicing of a food item.

In use, a user sets the required thickness for a slice by rotating the knob 32 to adjust the angle of the knife 14. To assist, the knob can have a marker and an appropriate slice thickness scale can be marked on the portion 30. A food item is then placed on the part 12*b* of the surface 12 and, whilst holding the portion 30 with one hand, the user reciprocates the item in the direction of the double arrow 50 in FIG. 1. As it moves downwardly in the sense of FIG. 1, the knife cuts a slice from the item and the slice passes through the opening 16 to beneath the slicer 10.

As can be appreciated, the slicer is simple to make and use. It can also be made, apart from the knife, of synthetic plastics material and can readily be cleaned and so is hygienic.

We claim:

1. A kitchen or domestic food slicer, comprising a substantially flat bed surface over which a food item to be sliced is manually reciprocable; a knife traversing the bed surface in an opening therein and pivotable about an axis substantially to said direction of reciprocation, the knife having a sharp leading edge; a sliding bar positioned at either side of the bed surface, the bars having inclined cam surfaces engaging opposite ends of the knife, and being moveable longitudinally to vary the angle of the knife in the opening and therefore to raise or lower the sharp leading edge of the knife relative to the surface so as to alter the thickness of a slice severed from the food item; and means for positioning the bars to set the knife to cut a preselected slice thickness.

2. A food slicer as claimed in claim 1 in which each bar defines a pair of opposing matching cam surfaces, and in which the ends of the knife include elongated dumb-bell shaped cam followers whose enlarged ends fit between and are held by the respective matching cam surfaces.

3. A food slicer as claimed in claim 1 in which a rotatable knob at one end of the bed surface is linked to the bars whereby rotation of the knob is translated into lengthwise movement of the bars in turn to adjust the angle of the knife in the opening.

* * * * *